US009472896B2

(12) United States Patent
Annis et al.

(10) Patent No.: US 9,472,896 B2
(45) Date of Patent: Oct. 18, 2016

(54) LATCH ASSEMBLIES FOR CONNECTOR SYSTEMS

(71) Applicant: Tyco Electronics Corporation, Berwyn, PA (US)

(72) Inventors: Kyle Gary Annis, Hummelstown, PA (US); Kevin Michael Thackston, York, PA (US); Matthew Richard McAlonis, Elizabethtown, PA (US); Albert Tsang, Harrisburg, PA (US); Dustin Carson Belack, Hummelstown, PA (US); Nicholas Paul Ruffini, York, PA (US); Chong Hun Yi, Mechanicsburg, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/709,030

(22) Filed: May 11, 2015

(65) Prior Publication Data

US 2015/0333443 A1 Nov. 19, 2015

Related U.S. Application Data

(60) Provisional application No. 61/996,784, filed on May 14, 2014.

(51) Int. Cl.

| | |
|---|---|
| ***H01R 13/62*** | (2006.01) |
| ***H01R 13/629*** | (2006.01) |
| ***H01R 13/641*** | (2006.01) |

(52) U.S. Cl.

CPC .. *H01R 13/62961* (2013.01); *H01R 13/62977* (2013.01); *H01R 13/641* (2013.01); *H01R 13/62922* (2013.01); *H01R 13/62944* (2013.01)

(58) Field of Classification Search

CPC ..... H01R 13/62961; H01R 13/62977; H01R 13/641; H01R 13/62944; H01R 13/62922

USPC ..... 439/157

See application file for complete search history.

(56) References Cited

U.S. PATENT DOCUMENTS

| | | | |
|---|---|---|---|
| 5,871,363 | A | 2/1999 | Kimura |
| 6,036,509 | A | 3/2000 | Maejima |

(Continued)

FOREIGN PATENT DOCUMENTS

| | | | |
|---|---|---|---|
| DE | 197 21 444 | A1 | 12/1997 |
| DE | 198 37 896 | A1 | 2/2000 |
| DE | 10 2011 005508 | A1 | 9/2012 |
| EP | 0 549 371 | A2 | 6/1993 |

(Continued)

OTHER PUBLICATIONS

European Search Report, Mail Date, Oct. 13, 2015, EP 15 16 7687, Application No. 15167687.1-1801.

*Primary Examiner* — Jean F Duverne

(57) ABSTRACT

A connector system includes a cavity configured to hold a connector module. The cartridge has a port opening to the cavity. The cartridge removably receives the connector module through the port. The connector system also includes an ejector mechanism. The ejector mechanism has a slider latch movable in a longitudinal direction relative to the cartridge. The slider latch has a profiled groove configured to cam therein. The slider latch has a linear gear. The ejector mechanism includes a rotatable handle having a circular gear configured to engage the linear gear to cause the slider latch to move as the rotatable handle is rotated between a closed position and an open position. The profiled groove engages the cam to secure the connector module to the connector assembly when the rotatable handle is in the closed position and unlock the connector module when in the open position.

20 Claims, 4 Drawing Sheets

(56) References Cited

U.S. PATENT DOCUMENTS

| | | | | |
|---|---|---|---|---|
| 8,235,742 | B2 * | 8/2012 | Komiyama ..... | H01R 13/62977 439/157 |
| 2005/0020114 | A1 | 1/2005 | Denter et al. | |
| 2010/0323535 | A1 * | 12/2010 | Brolin ..... | H01R 13/6467 439/62 |
| 2011/0260745 | A1 | 10/2011 | Naitou | |
| 2013/0337671 | A1 | 12/2013 | Tsang et al. | |

FOREIGN PATENT DOCUMENTS

| | | | |
|---|---|---|---|
| EP | 0 655 799 | A1 | 5/1995 |
| EP | 0 713 270 | A2 | 5/1996 |
| EP | 0 984 524 | A2 | 3/2000 |
| FR | 2 860 650 | A1 | 4/2005 |
| GB | 2 318 925 | A | 5/1998 |
| JP | H10 41007 | A | 2/1998 |
| JP | 2006 331991 | A | 12/2006 |
| WO | 2006/087097 | A1 | 8/2006 |

* cited by examiner

LATCH ASSEMBLIES FOR CONNECTOR SYSTEMS

CROSS REFERENCE TO RELATED APPLICATIONS

This application claims the benefit of U.S. Provisional Application No. 61/996,784 filed May 14, 2014 having the same title, the subject matter of which is herein incorporated by reference in its entirety.

BACKGROUND OF THE INVENTION

The subject matter herein relates generally to latch assemblies for connector systems.

Connector systems typically include electrical connectors and mating electrical connectors configured to be mated with corresponding electrical connectors. In some applications, the electrical connectors are part of a backplane. The electrical connectors are coupled to the backplane and positioned for mating with the mating electrical connectors. The electrical connectors may be mounted to the backplane.

Current retention methods include designs with screws that secure the electrical connectors to the backplane. Such retention methods require tools to assemble and unassembled, which is time consuming. Also, loosening of the screws due to vibration is another potential problem.

A need remains for a mechanism to retain an electrical connector to a surface in such a way to create a simple interface. A need remains for a tool-less means of attaching electrical connectors to a backplane.

BRIEF DESCRIPTION OF THE INVENTION

In one embodiment, a connector system is provided including a cartridge having a cavity configured to hold a connector module therein. The cartridge has a port opening to the cavity. The cartridge removably receives the connector module through the port. The connector system also includes an ejector mechanism. The elector mechanism has a slider latch movable in a longitudinal direction relative to the cartridge. The slider latch has a profiled groove configured to receive a cam therein. The slider latch has a linear gear extending along a portion thereof. The ejector mechanism includes a rotatable handle having a circular gear configured to engage the linear gear of the slider latch to cause the slider latch to move as the rotatable handle is rotated between a closed position and an open position. The profiled groove engages the cam to secure the connector module to the connector assembly when the rotatable handle is in the closed position and unlock the connector module when in the open position.

In another embodiment, a connector system is provided having a cartridge having a cavity configured to hold a connector module therein. The cartridge has a port opening to the cavity. The cartridge removably receives the connector module through the port. The cartridge has a housing having a cam therein. The connector system includes an ejector mechanism. The ejector mechanism includes a slider latch held by the connector module. The slider latch is movable in a longitudinal direction relative to the cartridge. The slider latch has a profiled groove configured to receive the cam. The slider latch has a linear gear extending along a portion thereof. The ejector mechanism also has a rotatable handle held by the connector module. The rotatable handle has a circular gear circumferentially surrounding a portion of a pivot axle. The circular gear is configured to engage the linear gear of the slider latch to cause the slider latch to move as the rotatable handle is rotated between a closed position and an open position. The profiled groove engages the cam to secure the connector module to the connector assembly when the rotatable handle is in the closed position and unlock the connector module from the cartridge when the rotatable handle is in the open position.

In another embodiment, a connector system is provided having a cartridge having a cavity configured to hold a connector module therein. The cartridge has a port opening to the cavity. The connector module has a housing having a cam extending therefrom. The connector system includes an ejector mechanism. The ejector mechanism includes a slider latch housed within the cavity of the cartridge. The slider latch is movable in a longitudinal direction relative to the cartridge. The slider latch has a profiled groove configured to receive the cam. The slider latch has a linear gear extending along a portion thereof. The ejector mechanism includes a rotatable handle held by the cartridge. The rotatable handle has a circular gear circumferentially surrounding a portion of a pivot axle. The circular gear is configured to engage the linear gear of the slider latch to cause the slider latch to move as the rotatable handle is rotated between a closed position and an open position. The profiled groove engages the cam to secure the connector module to the cartridge when the rotatable handle is in the closed position and unlock the connector module from the cartridge when the rotatable handle is in the open position.

DETAILED DESCRIPTION OF THE INVENTION

Figure 1:
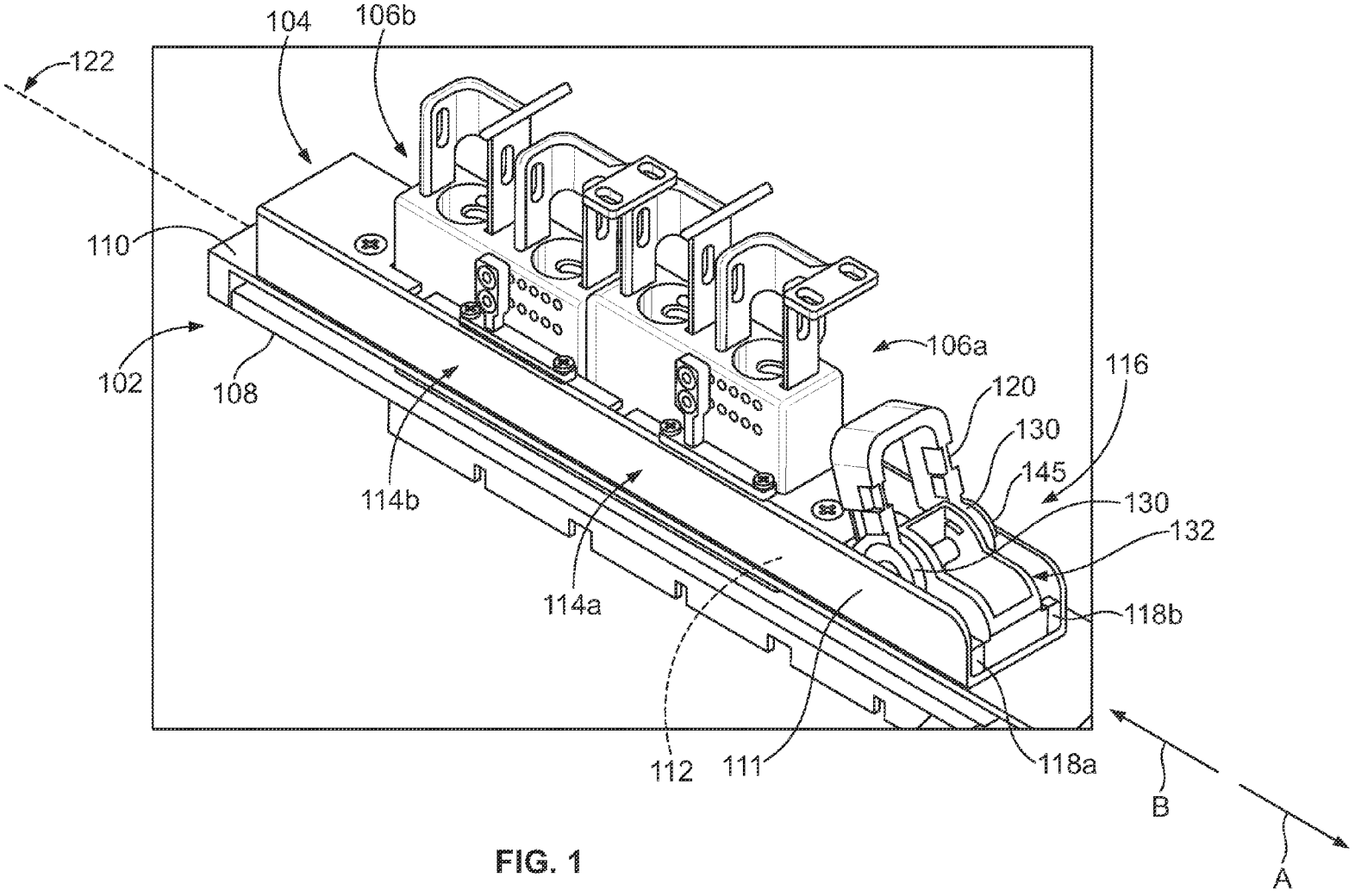
FIG. 1 is a front perspective view of a connector system formed in accordance with an embodiment.

FIG. 1 is a front perspective view of a connector system 100 formed in accordance with an exemplary embodiment. The connector system 100 includes a backplane 102 having a cartridge 104 mounted thereto. The cartridge 104 is configured to hold at least one connector module 106 therein. The illustrated embodiment includes connector modules 106*a* and 106*b*, however other embodiments may include more or fewer connector modules 106. The connector modules 106 are configured to be electrically connected to corresponding mating electrical connectors (not shown) in the backplane 102 as part of a network system, or other type of system. For example, the mating electrical connectors may be part of a printed circuit board (PCB) or a daughter card 108 that is made into the backplane 102.

The cartridge 104 is coupled to the backplane 102 and is used to couple the connector modules 106 to the backplane 102. The cartridge 104 may be coupled to the backplane 102 using fasteners (not shown) that extend into and/or through openings (not shown) in the backplane 102. The backplane 102 may include a stiffener 110 between the PCB 108 and the cartridge 104 to structurally support the cartridge 104.

The connector modules 106 may be any type of connectors. The connector modules 106 may include a plurality of contacts or terminals that are configured to be mated to corresponding contacts or terminals of the mating electrical connectors. The contacts or terminals may be terminated directly to the PCB 108 of the backplane 102, such as by surface mounting or through hole mounting to the backplane 102. Alternatively, the contacts or terminals may be terminated to ends of wires of the cables of the cable mounted electrical connectors. The contacts of terminals may be any types of contacts or terminals, such as pins, sockets, blades, tuning forks, plugs, receptacles, and the like. The electrical connectors may be fiber optic connectors in alternative embodiments.

The cartridge 104 includes a housing 111 defining at least one cavity 112 therein configured to hold the connector modules 106 therein. The cavity 112 includes at least one port 114 sized and shaped to receive one of the connector modules 106. In the illustrated embodiment, the cavity 112 has two ports 114*a* and 114*b* each holding the corresponding connector module 106*a* and 106*b*, respectively therein. In other embodiments, the cavity 112 may include more or fewer ports 114.

The connector system 100 includes an ejector mechanism 116 configured to couple the connector modules 106 to the cartridge 104 and uncouple the connector modules 106 form the cartridge 104. In an exemplary embodiment, the ejector mechanism 116 may eject the connector modules 106 from the cartridge 104; however in other embodiments, rather than ejecting the connector module 106 from the cartridge 104, the ejector mechanism may eject a locking feature from a locked position to an unlocked position, thus allowing the connector modules 106 to be removed by hand. The ejector mechanism 116 includes one or more slider latches 118 operably coupled to a rotatable handle 120. The slider latches 118 interact with cams 124 (shown in FIGS. 2 and 3) to cause the connector module 106 to move into, and out of the ports 114. In the illustrated embodiment, the ejector mechanism 116 includes the slider latches 118*a* and 118*b* engaging opposite sides of the rotatable handle 120.

The rotatable handle 120 is axially movable between a closed and an open position. When the rotatable handle 120 is moved to the closed position, the cams 124 and the slider latches 118 interact to pull the connector modules 106 into the cavity 112 to electrically and mechanically couple the connector modules 106 to the corresponding mating electrical connectors (not shown) on the PCB 108. When the rotatable handle 120 is in the closed position, the connector modules 106 may be locked in the cartridge 104. When the rotatable handle 120 is moved to the open position, the cams 122 and the slider latches 118 unlock the connector modules 106 from the cartridge 104 and may eject the connector modules 106 from the cartridge 104.

The rotatable handle 120 is coupled to the slider latches 118 such that rotation of the rotatable handle 120 causes the slider latches 118 to translate linearly in a longitudinal direction relative to the cartridge 104. The slider latches 118 are movable in the longitudinal direction indicated by the arrows A and B generally parallel to a longitudinal axis 122 of the cartridge 104. In the illustrated embodiment, the ejector mechanism 116 includes the slider latches 118*a* and 118*b* on opposite sides of the rotatable handle 120. The slider latch 118*a* may also be referred to as a first slider latch, and the slider latch 118*b* may be referred to as a second slider latch. Also as illustrated, the slider latches 118 (also shown in FIG. 2) are housed within the cavity 112 of the cartridge 104. But in other embodiments, other arrangements are possible.

In an exemplary embodiment, the cartridge 104 allows for quick connection and quick disconnection of the connector modules 106 from the backplane 102. For example, the cartridge 104 may disengage or eject one or more of the connector modules 106 held in each of the ports 114 at the same time. As such, the connector modules 106 are capable of being coupled to the cartridge 104 without the use of threaded fasteners or other types of connectors or fasteners that are time consuming to attach and detach.

Figure 2:
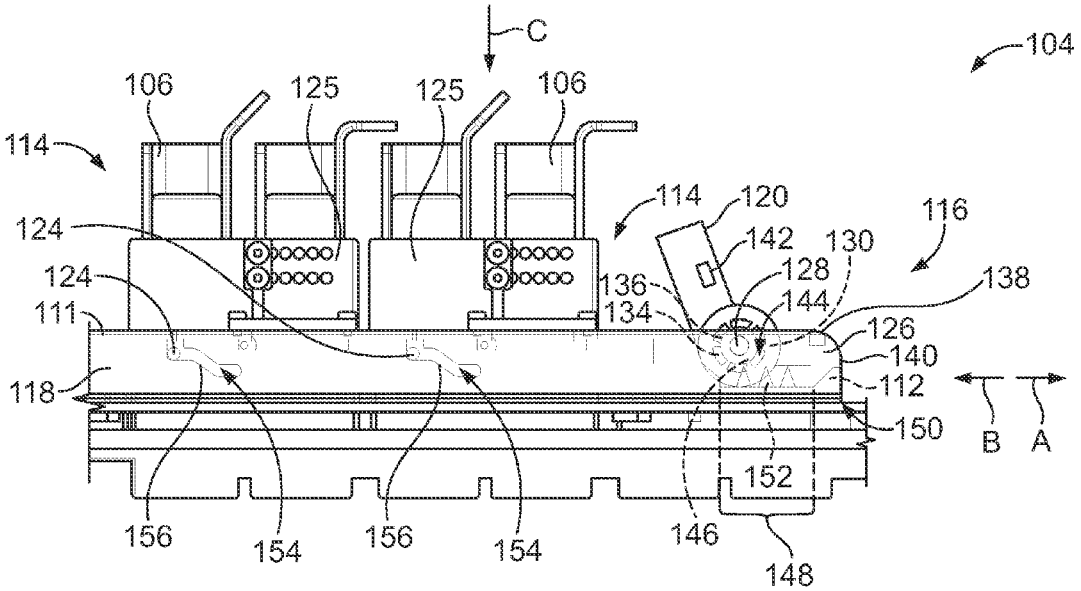
FIG. 2 is a side cross-sectional view of a cartridge with a rotatable handle in the open position formed in accordance with an embodiment.
Figure 3:
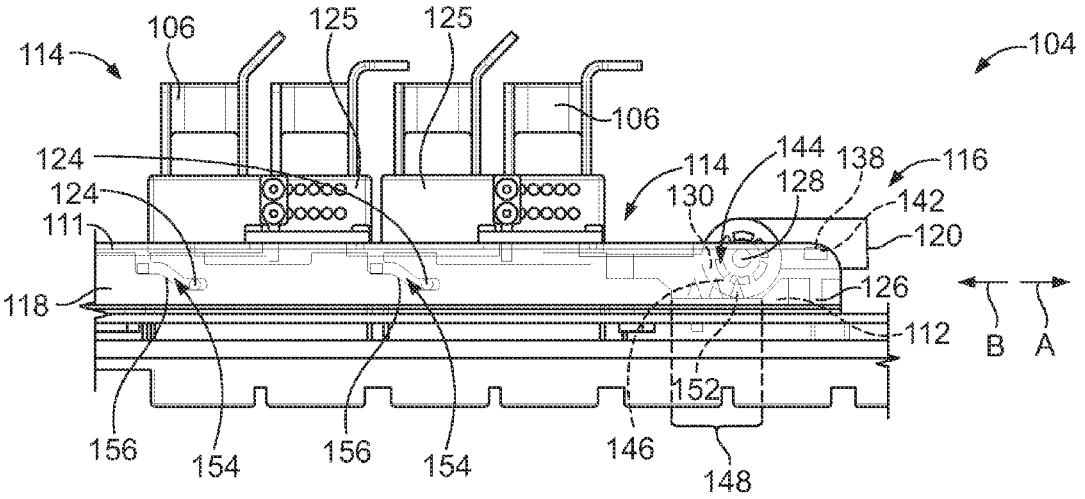
FIG. 3 is a side cross-sectional view of a cartridge with a rotatable handle in the closed position formed in accordance with an embodiment.

FIG. 2 is a side cross-sectional view of the cartridge 104 with the rotatable handle 120 in the open position. FIG. 3 is a side cross-sectional view of the cartridge 104 with the rotatable handle 120 in the closed position. In the illustrated embodiment, the slider latch 118 and the rotatable handle 120 are held by the housing 111, and the cams 124 are positioned on a housing 125 of each connector module 106. However, in other embodiments, other arrangements are possible.

The connector modules 106 are inserted into the ports 114 (also shown in FIG. 1) in a mating direction indicated by the arrow C (shown in FIG. 2). In certain embodiments, the cartridge 104 and/or the connector modules 106 may include features to polarize the connector modules 106 such that the connector modules 106 may be loaded into select ports 114 in select orientations. For example, the connector module 106 may include one or more harness keys configured pass through a keyway in the cartridge 104 to allow the connector module 106 to be received in select ports 114. Additionally or optionally, the housing 125 may include a second cam (not shown) on a second side of the housing 125. The second cam may be received by the second slider latch 118*b* (shown in FIG. 1).

The ejector mechanism 116 may include a base mount 126 held within the cavity 112 of the cartridge 104. The rotatable handle 120 (also shown in perspective view in FIG. 1) is rotatably coupled to the base mount 126 via a pivot axle 128. The base mount 126 includes flanges 130 (also shown in FIG. 1) along opposite sides of a center channel 132 (shown in FIG. 1). The pivot axle 128 is coupled to the both of the flanges 130 and spans the center channel 132. In the illustrated embodiment, the flanges 130 include an opening 134 therethrough. The rotatable handle 120 includes an opening 136 therethrough. The pivot axle 128 passes to and through the openings 134 and 136 to allow rotatable handle 120 to be coupled to the base mount 126 while being free to rotate about the pivot axle 128.

The flanges 130 may include a boss 138 on an outer surface 140. The rotatable handle 120 may include a detent 142 configured to align with, and engage the boss 138 when the rotatable handle 120 is moved to the closed position (as shown in FIG. 3). When the boss 138 engages the detent 142, the detent 142 may create an audible indication (for example, a clicking sound). Other types of indications may be provided when the handle 120 is in the closed position, such as a visual indication. Additionally, an indication may be provided indicating the handle 120 is in the open position. Additionally or optionally, the detent 142 may provide a friction fit with the boss 138. As such, boss 138 may hold the rotatable handle 120 in the closed position to prevent the rotatable handle 120 from inadvertently moving, for example, out of the closed position. For example, the boss 138 may prevent movement of the rotatable handle 120 caused by vibration. In other embodiments, other securing means may be used to hold the rotatable handle 120 in the closed position.

The rotatable handle 120 includes at least one circular gear 144 circumferentially surrounding the pivot axle 128. In the illustrated embodiment, the circular gear 144 surrounds approximately 180° of the pivot axle 128, but in other embodiments, the circular gear 144 may extend around the entire perimeter of the pivot axle 128. The circular gear 144 includes a plurality of teeth 146. The circular gear 144 may be integrally formed with the rotatable handle 120. In other embodiments, the circular gear 144 may be a separate component that is joined to the rotatable handle 120. The rotatable handle 120 may include a second circular gear 145 (shown in FIG. 1) on an opposite side. The second slider latch 118*b* (shown in FIG. 1) may engage the second circular gear 145 in a similar arrangement.

The slider latch 118 includes a linear gear 148 extending along a portion of a distal end 150 of the slider latch 118. The linear gear 148 is complementary to the circular gear 144. The linear gear 148 includes teeth 152 having a pitch and depth compatible with the teeth 146 of the circular gear 144. The circular gear 144 and the linear gear 148 may mesh such that rotational movement of the rotation handle 120, and hence the circular gear 144, causes linear movement of the slider latch 118. As the rotation handle 120 is rotated from the open position to the closed position, the slider latch 118 is translated in the direction B. The slider latch 118 is in a latched position when the rotation handle 120 is in the closed position. As the rotation handle 120 is rotated from the closed position to the open position, the slider latch 118 is translated in the direction A. The slider latch 118 is in an unlatched position when the rotation handle 120 is in the open position.

The slider latch 118 includes profiled grooves 154. The profiled grooves 154 each include an inclined surface 156 configured to guide the cams 124 into and out of the cavity 112. The slider latch 118 latches the connector module 106 within the cartridge 104 by resisting removal of the cams 124 from the corresponding profiled grooves 154. The slider latch 118 moves in the direction A to eject the cartridge 104 by sliding the cam 124 along the inclined surface 156 to push the cartridge 104 out of the cavity 112. The slider latch 118 moves in the direction B to load the cartridge 104 by sliding the cam 124 along the inclined surface 156 to pull the cartridge 104 into the cavity 112.

Figure 4:
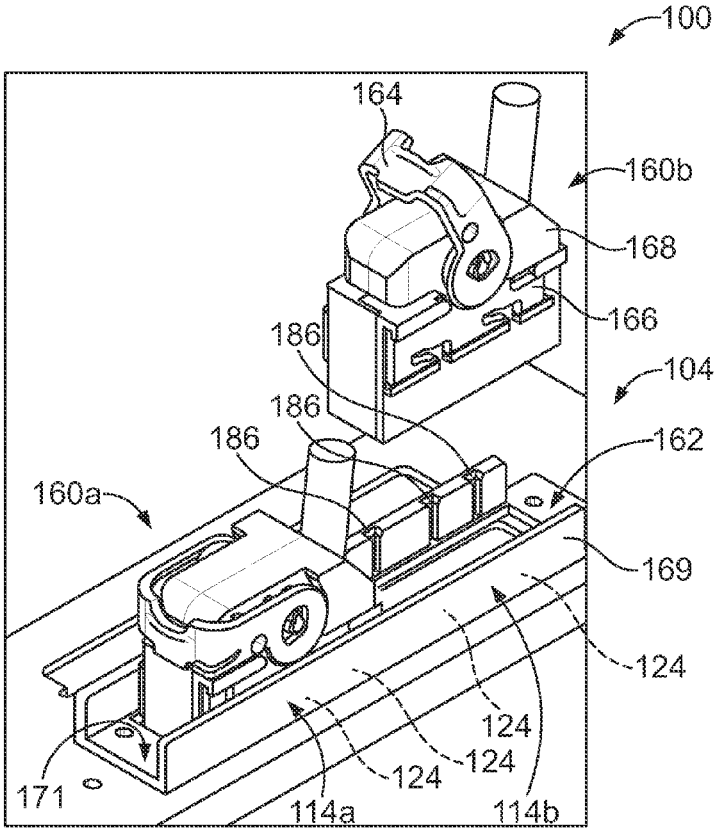
FIG. 4 is a front perspective view of an embodiment of a connector system having an ejector mechanism with individually releasable connector modules formed in accordance with an embodiment.

FIG. 4 is a front perspective view of an embodiment of the connector system 100 having an ejector mechanism 116 with individually releasable connector modules 160. In the illustrated embodiment, the connector modules 160*a* and 160*b* are configured to be loaded into the ports 114*a* and 114*b*, respectively, of a cartridge 162 one at a time, and are ejected from the cartridge 162 one at a time. A rotatable handle 164 is coupled to each connector module 160 instead of the base mount 126 as shown in FIGS. 2 and 3. Additionally, the rotatable handle 164 interacts with a slider latch 166 that is slidably attached to a housing 168 of the connector module 160 instead of the housing 169 of the cartridge 162. The slider latch 166 interacts with cams 124 on the housing 169 of the cartridge 104 instead of on the connector module 106 as shown in FIGS. 2 and 3. The cams 124 extend from an inside surface 171 in the cavity 112. As illustrated the connector module 160 is shown with the rotatable handle 164 in the closed positioned. The connector module 160*b* is shown with the rotatable handle 164 in the open position.

Figure 5:
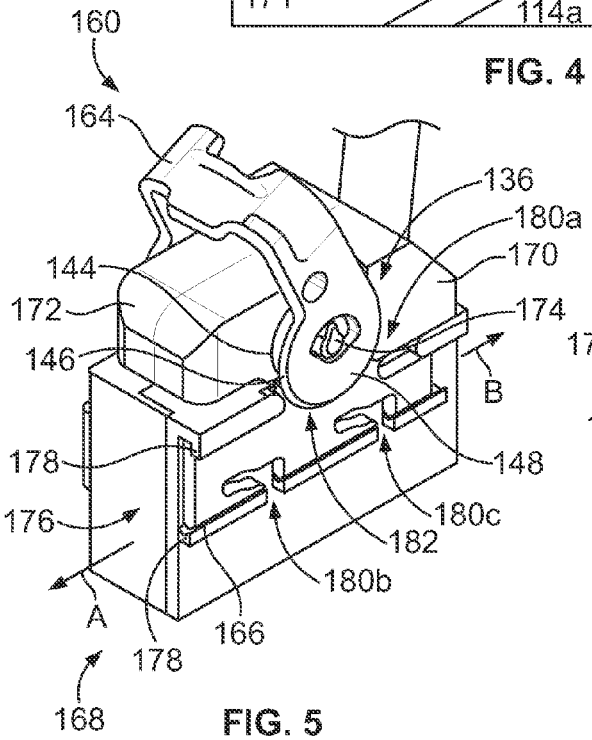
FIG. 5 is a front perspective of a connector module formed in accordance with an embodiment.
Figure 6:
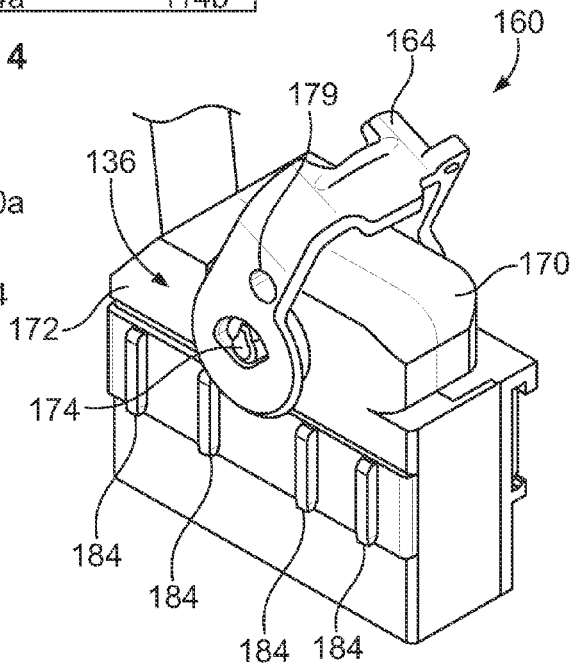
FIG. 6 is a back perspective view of a connector module formed in accordance with an embodiment.

FIG. 5 is a front perspective of the connector module 160. FIG. 6 is a back perspective view of the connector module 160.

The housing 168 includes a top shell 170 and a bottom shell 172. The rotatable handle 164 straddles the housing 168 such that one leg is coupled to the top shell 170 and the other leg is coupled to the bottom shell 172. The top and bottom shells 170, 172 each include pivot members 174 extending therefrom. The pivot members 174 extend through the openings 136 in the rotatable handle 164 to pivotably couple the rotatable handle 164 to the connector module 160.

Figure 7:
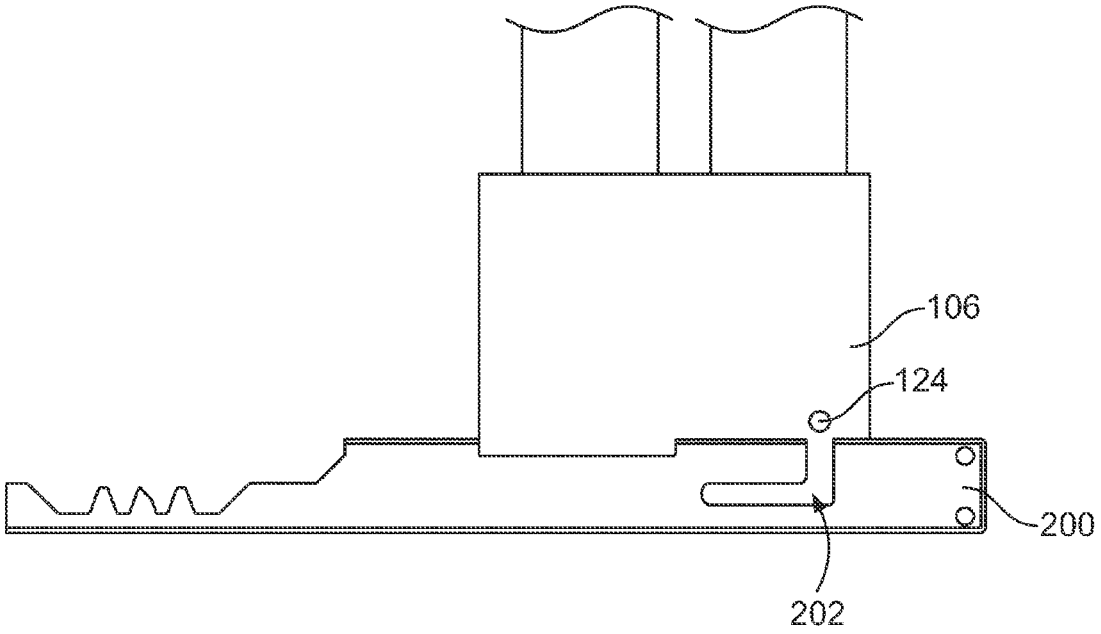
FIG. 7 is a side view of the connector module in accordance with an exemplary embodiment.

The top shell 170 includes a passage 176 sized and shaped to receive the slider latch 166. The passage 176 includes flanges 178 extending toward one another across the passage 176 to slidably capture the slider latch 166 therein. The flanges 178 allow the slider latch 166 to translate in the directions A and B, while holding the sider latch 166 against the top shell 170. The flanges 178 are segmented to allow the cams 124 (shown in FIGS. 7 and 8) and the circular gear 144 to contact and interact with the slider latch 166. For example, the flanges 178 includes the gaps 180*a*, 180*b*, and 180*c* opening into the passage 176.

In the illustrated embodiment, the rotatable handle 164 includes a shield 182 extending around the circular gear 144. The shield 182 extends around the circular gear 144 such that the shield extends radially outward beyond the teeth 146. The shield is configured to prevent foreign objects and/or debris from fouling the circular gear 144 and the linear gear 148.

The rotatable handle 164 may also include a detent 179 configured to align with and engage a boss 181 on the top shell 170 and/or the bottom shell 172. The boss 181 engages the detent 179 when the rotatable handle 164 is moved to the closed position. When the boss 181 engages the detent 179, the detent 179 may create an audible indication (for example, a clicking sound). Additionally or optionally, the detent 179 may provide a friction fit with the boss 181. As such the boss 181 may hold the rotatable handle 164 in the closed position.

The bottom shell 172 includes keys 184 configured to polarize the connector module 160. The keys 184 are received in slots 186 (shown in FIG. 4) on the housing 169 of the cartridge 162 when the connector module 160 is loaded into the cartridge 162. The keys 184 prevent the connector module 160 from being inserted in an orientation such that the keys 184 are not aligned with the slots 186. In the illustrated embodiment, only the bottom shell 172 includes the keys 184. However, in other embodiments, the top shell 170 may include keys 184 that are offset from the keys 184 on the bottom shell 172. Optionally, the keys 184 may be removable or reconfigurable to define different keying arrangements. The keys 184 may provide guidance during mating and may include lead-ins to assist mating.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112(f) unless and until such claim limitations expressly use the phrase "means for" followed by a statement of function void of further structure.

What is claimed is:

1. A connector system comprising:

a cartridge having a cavity configured to hold a connector module therein, the cartridge having a port opening to the cavity, the cartridge removably receiving the connector module through the port;

an ejector mechanism having:

a slider latch being movable in a longitudinal direction relative to the cartridge, the slider latch having a profiled groove configured to receive a cam therein, the slider latch having a linear gear extending along a portion thereof; and a rotatable handle having a circular gear circumferentially surrounding a portion of a pivot axle, the circular gear configured to engage the linear gear of the slider latch to cause the slider latch to move as the rotatable handle is rotated between a closed position and an open position;

wherein the profiled groove engages the cam to secure the connector module to the connector assembly when the rotatable handle is in the closed position and unlock the connector module from the cartridge when the rotatable handle is in the open position.

2. The connector system of claim 1, wherein the rotatable handle causes the slider latch to move to a latched position when the rotatable handle is moved to the closed position, and the rotatable handle causes the slider latch to move to an unlatched position when the rotatable handle is moved to the open position.

3. The connector system of claim 1, wherein the slider latch and the rotatable handle are housed within the cartridge, and the cam is positioned on a housing of the connector module.

4. The connector system of claim 1, wherein the slider latch and the rotatable handle are held by the connector module and the cam is positioned on a housing of the cartridge.

5. The connector system of claim 1, wherein the circular gear on the rotatable handle defines a first circular gear, the slider latch defines a first slider latch, the rotatable handle having a second circular gear on an opposite side of the rotatable handle, the connector system having a second slider latch configured to engage the second circular gear.

6. The connector system of claim 1, wherein the connector module includes keys configured to polarize the connector module such that the keys interact with slots on a housing of the cartridge.

7. The connector system of claim 1, wherein the rotatable handle produces an indication when the rotatable handle is moved to the closed position.

8. The connector system of claim 1, wherein the circular gear includes a plurality of teeth extending radially outward from the pivot axle, the rotatable handle including a shield extending around the circular gear such that the shield extends radially outward beyond the teeth.

9. The connector system of claim 1, wherein the slider latch is configured to eject the connector module from the cartridge when the rotatable handle is moved to the open position.

10. A connector system comprising:

a cartridge having a cavity configured to hold a connector module therein, the cartridge having a port opening to the cavity, the cartridge removably receiving the connector module through the port, the cartridge having a housing having a cam therein;

an ejector mechanism having:

a slider latch held by the connector module, the slider latch being movable in a longitudinal direction relative to the cartridge, the slider latch having a profiled groove configured to receive the cam, the slider latch having a linear gear extending along a portion thereof; and a rotatable handle held by the connector module, the rotatable handle having a circular gear circumferentially surrounding a portion of a pivot axle, the circular gear configured to engage the linear gear of the slider latch to cause the slider latch to move as the rotatable handle is rotated between a closed position and an open position;

wherein the profiled groove engages the cam to secure the connector module to the connector assembly when the rotatable handle is in the closed position and unlock the connector module from the cartridge when the rotatable handle is in the open position.

11. The connector system of claim 10, wherein the rotatable handle causes the slider latch to move to a latched position when the rotatable handle is moved to the closed position and the rotatable handle causes the slider latch to move to an unlatched position when the rotatable handle is moved to the open position.

12. The connector system of claim 10, wherein the connector module includes keys configured to polarize the connector module such that the keys interact with slots on a housing of the cartridge.

13. The connector system of claim 10, wherein the slider latch is configured to eject the connector module from the cartridge when the rotatable handle is moved to the open position.

14. The connector system of claim 10, wherein the gear portion includes a plurality of teeth extending radially outward from the pivot axle, the rotatable handle including a shield extending around the geared portion such that the shield extends radially outward beyond the teeth.

15. A connector system comprising:

a cartridge having a cavity configured to hold a connector module therein, the cartridge having a port opening to the cavity, the connector module having a housing having a cam extending therefrom, the cartridge removably receiving the connector module through the port;

an ejector mechanism having:

a slider latch housed within the cavity of the cartridge, the slider latch being movable in a longitudinal direction relative to the cartridge, the slider latch having a profiled groove configured to receive the cam, the slider latch having a linear gear extending along a portion thereof; and a rotatable handle held by the cartridge, the rotatable handle having a circular gear circumferentially surrounding a portion of a pivot axle, the circular gear configured to engage the linear gear of the slider latch to cause the slider latch to move as the rotatable handle is rotated between a closed position and an open position;

wherein the profiled groove engages the cam to secure the connector module to the cartridge when the rotatable handle is in the closed position and unlock the connector module from the cartridge when the rotatable handle is in the open position.

16. The connector system of claim 15, wherein the rotatable handle causes the slider latch to move to a latched position when the rotatable handle is moved to the closed position, and the rotatable handle causes the slider latch to move to an unlatched position when the rotatable handle is moved to the open position.

17. The connector system of claim 15, wherein the connector module includes keys configured to polarize the connector module such that the keys interact with slots on a housing of the cartridge.

18. The connector system of claim 15, wherein the geared portion on the rotatable handle defines a first geared portion, the slider latch defines a first slider latch, the rotatable handle having a second geared portion on an opposite side of the rotatable handle, the connector system having a second slider latch configured to engage the second geared portion.

19. The connector system of claim 15, wherein the slider latch is configured to eject the connector module from the cartridge when the rotatable handle is moved to the open position.

20. The connector system of claim 15, wherein the rotatable handle produces an indication when the rotatable handle is moved to the closed position.

* * * * *